US006422178B1

(12) United States Patent
Lannes et al.

(10) Patent No.: US 6,422,178 B1
(45) Date of Patent: Jul. 23, 2002

(54) FUEL-FIRED HEATING APPLIANCE WITH LOUVERED COMBUSTION CHAMBER FLAME ARRESTOR PLATE

(75) Inventors: Eric M. Lannes; Mark A. Taylor, both of Kentwood; Larry D. Kidd, Nashville, all of MI (US)

(73) Assignee: The Water Heater Industry Joint Research and Development Consortium, Reston, VA (US)

( * ) Notice: Subject to any disclaimer, the term of this patent is extended or adjusted under 35 U.S.C. 154(b) by 0 days.

(21) Appl. No.: 09/904,284

(22) Filed: Jul. 12, 2001

(51) Int. Cl.[7] ..... F22B 5/04
(52) U.S. Cl. ..... 122/14.31; 122/17.1
(58) Field of Search ..... 122/14.31, 17.1, 122/13.01, 5.51; 431/326; 126/350.1

(56) References Cited

U.S. PATENT DOCUMENTS

| | | | | |
|---|---|---|---|---|
| 4,033,714 A | | 7/1977 | Longworth | 431/354 |
| 5,941,200 A | | 8/1999 | Boros et al. | 122/13.1 |
| 6,003,477 A | | 12/1999 | Valcic | 122/13.1 |
| 6,036,480 A | | 3/2000 | Hughes et al. | 431/353 |
| 6,082,310 A | | 7/2000 | Valcic et al. | 122/14 |
| 6,109,216 A | | 8/2000 | Reynolds et al. | 122/13.01 |
| 6,116,195 A | | 9/2000 | Valcic et al. | 122/13.1 |
| 6,142,106 A | * | 11/2000 | Overbey, Jr. et al. | 122/5.51 |

* cited by examiner

*Primary Examiner*—Gregory Wilson
(74) *Attorney, Agent, or Firm*—Konneker & Smith, P.C.

(57) ABSTRACT

A fuel-fired heating appliance, representatively a gas-fired water heater, has a combustion chamber with an outer wall portion defined by a perforated flame arrestor plate having specially configured louvered combustion air intake openings through which combustion air is flowed into the combustion chamber. The louvered openings function to cause the entering combustion air to undergo directional changes as it inwardly traverses the openings and impart turbulence to the air entering the combustion chamber in a manner substantially inhibiting foreign matter blockage of the plate openings, providing an even combustion air inflow across the perforated plate area, and providing the plate with improved operational temperature uniformity along its sides.

45 Claims, 2 Drawing Sheets

FUEL-FIRED HEATING APPLIANCE WITH LOUVERED COMBUSTION CHAMBER FLAME ARRESTOR PLATE

BACKGROUND OF THE INVENTION

The present invention generally relates to fuel-fired heating appliances and, in a preferred embodiment thereof, more particularly provides a gas-fired water heater with a combustion chamber having incorporated therein a specially designed louvered flame arrestor plate through which combustion air is operatively flowed into the chamber.

Gas-fired residential and commercial water heaters are generally formed to include a vertical cylindrical water storage tank with a gas burner disposed in a combustion chamber below the tank. The burner is supplied with a fuel gas through a gas supply line, and combustion air through one or more air inlet openings providing communication between ambient air and the interior of the combustion chamber.

In order to permit the flow of combustion air into the combustion chamber, while at the same time prevent the outflow of flames from the combustion chamber, various proposals have been made to provide the combustion chamber with an exterior wall portion having a spaced series of flame quenching openings formed therein, such openings being configured to permit the ingress of combustion air into the combustion chamber, while at the same time preventing the passage of combustion chamber flames outwardly through these openings. Accordingly, in the event that extraneous flammable vapors enter the combustion chamber with combustion air inwardly traversing these flame quenching openings, flames resulting from ignition of the incoming flammable vapor will be contained within the combustion chamber. An example of one previously proposed perforated flame arrestor plate structure used in this manner as an exterior wall portion of a gas-fired water heater combustion chamber is illustrated and described in U.S. Pat. No. 5,941,200 to Boros et al.

While perforated flame quenching arrestor plates of this general type are generally well suited for their intended purpose, arrestor plates of conventional constructions and configurations have certain known limitations and disadvantages. For example, they can be difficult to design in a manner providing uniform combustion air inlet flow over their entire perforated area, may be susceptible to uneven temperature distributions along their surfaces, and may also be prone to becoming partially clogged with lint and other airborne debris, thereby requiring periodic cleaning during the operational lifetime of their associated water heater.

In view of these limitations it would be desirable to provide a fuel-fired heating appliance, such as a water heater, having an improved perforated combustion chamber flame arrestor plate that eliminates or at least substantially alleviates the above-mentioned limitations and disadvantages of conventionally configured flame arrestor plates. It is to this goal that the present invention is primarily directed.

SUMMARY OF THE INVENTION

In carrying out principles of the present invention, in accordance with a preferred embodiment thereof, a specially designed flame arrestor plate is illustratively incorporated in a fuel-fired heating apparatus which is representatively a gas-fired water heater, but could be a variety of other types of fuel-fired heating apparatus such as, for example, a furnace or boiler. The fuel-fired heating apparatus comprises a combustion chamber thermally communicatable with a fluid to be heated, and a burner operatively disposed within the combustion chamber. The flame arrestor plate structure has a generally planar body, representatively of a suitable metal material, and illustratively defines a bottom wall portion of the combustion chamber. The body has a series of louvered openings therein which are configured as flame quenching openings that permit combustion air to flow therethrough into the combustion chamber and substantially preclude flame passage outwardly therethrough from the combustion chamber.

In a preferred embodiment of the flame arrestor plate structure, each of the louvered openings is bordered by a bounding portion of the body including first and second spaced apart body wall segments, with each louvered opening having an inlet on a first side of the body, and an outlet disposed on a second side of the body and having an area substantially smaller than the area of the inlet. The first body wall segment is angled relative to the plane of the body and has a generally planar side surface and a first corner edge that partially bound the louvered opening, the second body wall segment has a generally planar end surface and a second corner edge that partially bound the louvered opening, and the first and second corner edges extend along the outlet in a spaced apart parallel relationship. Representatively, each louvered opening is elongated in a direction parallel to its associated first and second corner edges.

According to a first operational feature of the flame arrestor plate, each of the bounding portions of the body is operative to create counter-rotating vortices in combustion air exiting its associated louvered opening and entering the combustion chamber. According to a second operational feature of the flame arrestor plate, each bounding portion is operative to create in combustion air flowing through its associated louvered opening into the combustion chamber a laminar flow area (i.e., with a Reynold's number less than or equal to about 2100) extending along the generally planar side surface of the first body wall segment, a turbulent flow area (i.e., with a Reynold's number greater than about 4000) extending along the generally planar end surface of the second body wall segment, and a transitional flow area (i.e., with a Reynold's number of from about 2100 to about 4000) disposed between the laminar flow area and the turbulent flow area. According to a third operational feature of the flame arrestor plate, each bounding portion is operative to create at least two directional changes in combustion air inwardly traversing its associated louvered opening.

The turbulence created in air discharged from the louvered openings into the combustion chamber substantially facilitates the prevention of clogging of the openings with lint or other particulate matter entrained in the incoming combustion air. This prevention of lint/particulate clogging of the louvered inlet openings is preferably augmented by positioning the first and second corner edges of each opening in a spaced apart, parallel relationship with the edges being separated, in a direction parallel to the plane of the plate body, by a small gap which permits particulates within the combustion chamber to fall vertically through the openings during non-firing periods of the fuel-fired heating appliance.

According to a fourth operational feature of the flame arrestor plate, the configuration of the louvered openings creates a pressure in combustion air exiting the openings into the combustion chamber which is substantially lower than combustion air entering the openings. This facilitates desirably even combustion air inflow, at both normal and above normal firing rates, across the perforated area of the plate body to accordingly provide a substantially uniform temperature along the plate body and an even pattern of foreign material (such as lint) distribution along the unperforated bottom side surface area of the plate body.

In addition to the above-mentioned particulate fall-through gap, various other configurational features are also illustratively incorporated into the flame arrestor plate, in a preferred embodiment thereof. Such configurational features include at each louvered opening (1) the outward sloping of the generally planar end surface of the first body wall segment away from the second body wall segment at an acute angle relative to a reference plane transverse to the plane of the plate body; (2) the provision of each of the louvered openings with a ratio of interior surface area to outlet opening area which is greater than about 120; and (3) the configuring of each louvered opening in a manner such that it has a total flow volume defined by a first flow volume extending along the generally planar side surface of the first plate wall segment, and a second flow volume equal to the first flow volume and extending along the generally planar end surface of the second body wall segment, and the interior plate surface area contacted by the first flow volume is substantially greater than the interior plate surface area contacted by the second flow volume.

DETAILED DESCRIPTION

Figure 1:
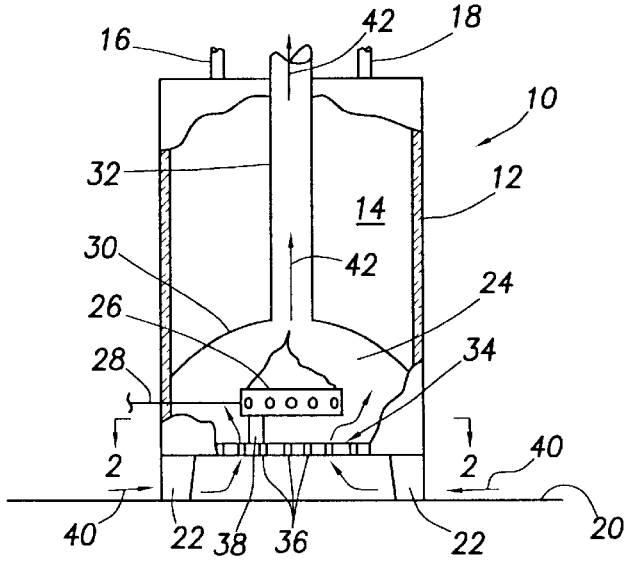
FIG. 1 is a simplified, highly schematic, partly elevational cross-sectional view through a representative gas-fired water heater having incorporated therein a specially designed louvered combustion chamber flame arrestor plate embodying principles of the present invention.

Illustrated in simplified cross-sectional form in FIG. 1 is a fuel-fired heating appliance, representatively a gas-fired water heater 10, that embodies principles of the present invention. Water heater 10 has a vertically oriented cylindrical insulated metal storage tank 12 which is adapted to hold a quantity of pressurized water 14 to be heated and stored for on-demand delivery to a variety of hot water-utilizing plumbing fixtures (not shown) via a supply pipe 16 connected to the top end of the tank 12. Water 14 drawn from the tank 12 is automatically replenished via a cold water inlet pipe 18 also connected to the top end of the tank 12.

The tank 12 is representatively supported on a floor 20, in an elevated relationship therewith, by depending support legs 22. At the lower end of the tank 12 is a combustion chamber 24 in which a schematically depicted gas burner structure 26 is operatively supported, the burner structure 26 being supplied with fuel gas via a supply line 28 and thermostatically controlled in a conventional manner as a function of the setpoint temperature of the stored water 14. Combustion chamber 24 has a domed top wall 30. A flue 32 extends upwardly from a central portion of the wall 30, through the water 14 and outwardly through the top end of the tank 12, and communicates with the interior of the combustion chamber 24.

A bottom outer wall portion of the combustion chamber 24 is defined by a specially designed flame arrestor plate 34 which embodies principles of the present invention and has a spaced series of flame quenching combustion air inlet openings 36 formed therein. The burner structure 26 is held in an elevated relationship with the top side of the flame arrestor plate 34 by a schematically depicted support structure 38.

During firing of the water heater 10, ambient combustion air 40 is flowed into the combustion chamber 24 via the air inlet openings 36, mixed with fuel gas delivered to the burner structure 26, and combusted to form hot combustion products 42 that upwardly traverse the flue 32 and transfer combustion heat to the water 14 through the sidewall of the flue 32. In a manner subsequently described herein, the arrestor plate inlet openings 36 function to permit combustion air 40 to be drawn upwardly therethrough into the combustion chamber 24, but preclude downward passage through the openings 36 of flames from the interior of the combustion chamber 24. Accordingly, in the event that extraneous flammable vapors are entrained in the combustion air 40, drawn into the combustion chamber 24 and ignited therein, the resulting flammable vapor flames are kept in the combustion chamber and tend to be self-extinguishing.

The illustrated combustion air inlet path to the flame arrestor plate 34 has been schematically depicted in FIG. 1, and is merely representative of a variety of such paths which could be provided for the water heater 10. AS but one example of an alternative combustion air inlet path to the flame arrestor plate 34, a ducted path could be provided to the flame arrestor plate 34 with such ducted path having a combustion air inlet opening which is elevated with respect to both the floor 20 and the flame arrestor plate 34.

Turning now to FIGS. 2–6, the flame quenching perforated arrestor plate 34 is representatively formed from an initially imperforate, substantially planar metal plate body 42 having upper and lower sides 44,46 and a thickness T which is representatively in the range of from about 0.015" to about 0.040", and is preferably about 0.026". The flame quenching openings 36 are created using a suitable lancing process to form in the plate body 42 parallel rows of upwardly deformed elongated louvers 48, with each of the flame quenching combustion air inlet openings 36 being disposed between a laterally adjacent pair of the louvers 48. Alternatively, the rows of louvers 48 could be staggered, or in other relative orientations, instead of being parallel.

Figure 2:
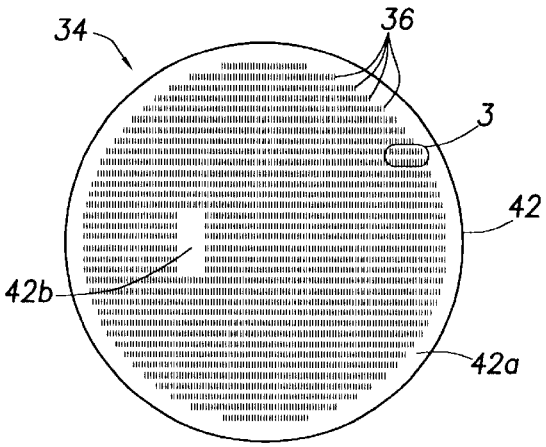
FIG. 2 is an enlarged scale top plan view of the flame arrestor plate taken along line 2—2 of FIG. 1.
Figure 3:
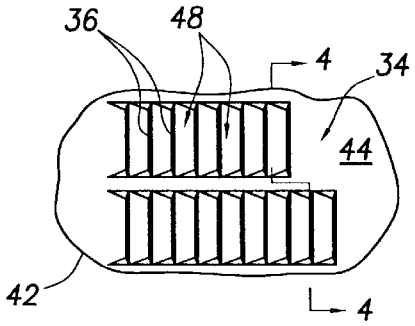
FIG. 3 is an enlarged scale detail view of the area "3" in FIG. 2.

AS can best be seen in FIG. 2, the plate body 42 has a circular shape and is diametrically configured to cover essentially the entire bottom side of the combustion chamber 24. Representatively, a substantially larger sheet of metal has louvers 48 lanced therein and has the circular body 42 suitably removed therefrom. The removed circular body 42 has the louvers crimped down around its periphery to form an annular, imperforate peripheral area 42*a* which facilitates the connection of the body 42 at the bottom of the combustion chamber 24. Additionally, a rectangular area 42*b* is crimped down to form on the top side of the body 42 an imperforate securement area 42*b* on which the burner support structure 38 (see FIG. 1) may be suitably mounted. Alternatively, the imperforate areas 42*a* and 42*b* could initially be formed without perforations.

While the flame arrestor plate body 42 illustratively has a circular shape and covers essentially the entire bottom end of the combustion chamber 24, it could have a different shape and cover a lesser portion of the bottom end of the combustion chamber 24. For example, the plate body 42 could have a rectangular shape and be an insert in a portion of a larger imperforate metal plate complementarily mounted within the open bottom end of the combustion chamber 24.

Figure 4:
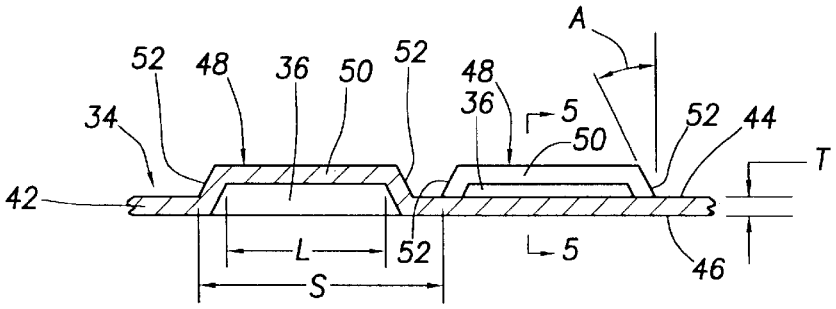
FIG. 4 is an enlarged scale cross-sectional view through a portion of the flame arrestor plate taken along line 4—4 of FIG. 3.
Figure 5:
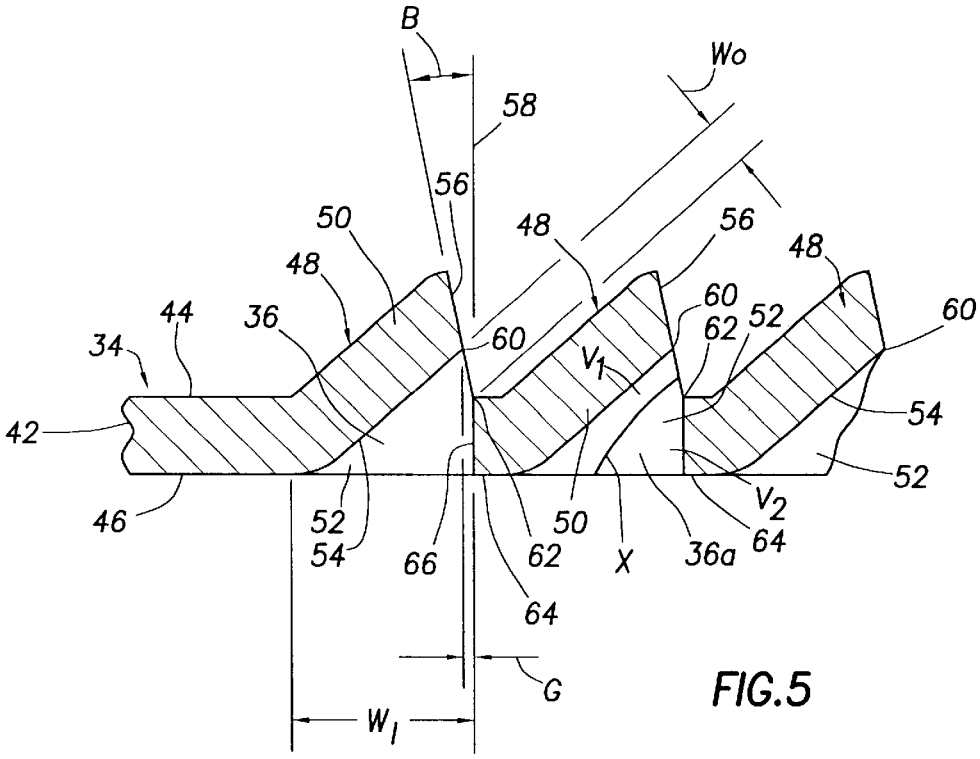
FIG. 5 is an enlarged scale cross-sectional view through a portion of the flame arrestor plate taken along line 5—5 of FIG. 4.
Figure 6:
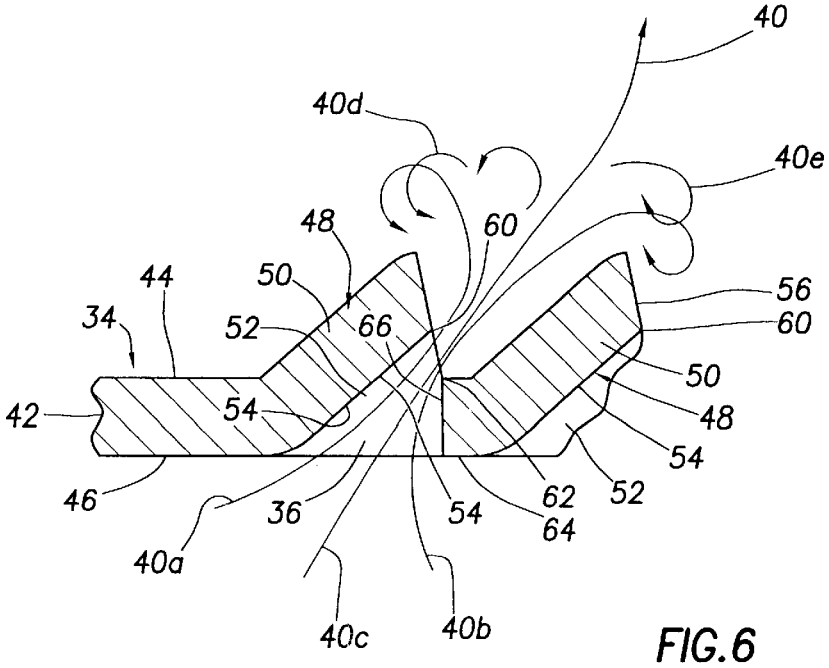
FIG. 6 is a cross-sectional view similar to that in FIG. 5 and illustrating combustion air flow through one of the louvered openings in the flame arrestor plate.

With reference now to FIGS. 4–6, each louver 48 has an upwardly bent top plate wall segment 50 which extends along the length of its associated flame quenching combustion air inlet opening 36 and is upwardly slanted in a rightward or forward direction relative to the plate body 42, and a pair of end walls 52 which are upwardly and horizontally inwardly sloped toward one another at an angle A (see FIG. 4) which is in the range of from about 11 degrees to about 45 degrees, and preferably about 30 degrees, relative to the top side 44 of the plate body 42. Each forwardly and upwardly sloped top plate wall segment 50 has an essentially planar bottom side surface 54 that slopes forwardly and upwardly at an angle within the range of from about 40 degrees to about 70 degrees, and preferably about 50 degrees, relative to the top side 44 of the plate body 42, and a substantially planar front or outer end surface 56 which is upwardly and rearwardly sloped at an angle B within the range of from about 0 degrees to about 15 degrees, and preferably about 12 degrees, relative to a vertical reference plane 58 extending parallel to the horizontal length of the associated combustion air inlet opening 36 and transverse to the plane of the plate body 42.

A relatively sharp edge 60 extends along the juncture of the surfaces 54 and 56 of each louver plate segment 50. Edge 60 horizontally extends along the top side of the outlet of the associated flame quenching combustion air inlet opening 36 (see FIG. 5) and is in a parallel, spaced apart and opposing relationship with an elongated, relatively sharp edge 62 extending along the bottom side of the outlet of the combustion air inlet opening 36 and disposed on a front plate wall segment 64 having a substantially planar, rearwardly facing horizontally elongated surface 66 upwardly terminating at the edge 62.

Representatively, the minimum length L of each combustion air intake opening 36 (see FIG. 4) is in the range of from about 0.10" to about 0.20", and is preferably about 0.15", and the distance S between the rows of louvers 48 is in the range of from about 0.20" to about 0.40", and is preferably about 0.22". AS shown in FIG. 5, each flame quenching combustion air inlet opening 36 has a bottom inlet width $W_1$. which is substantially greater than its top outlet width $W_0$. Representatively, the inlet width $W_1$ is in the range of from about 0.08" to about 0.10", and is preferably about 0.085", and the outlet width $W_0$ is in the range of from about 0.015" to about 0.023", and is preferably about 0.018". Additionally, there is a horizontal gap G between each associated pair of outlet edges 60,62 Which has a width in the range of from about 0" to about 0.023", and is preferably about 0.01".

According to another configurational feature of the arrestor plate 34, at each combustion air inlet opening 36, such as the opening 36*a* shown in FIG. 5, a reference boundary x extends from the lateral midpoint of the inlet portion of the opening to the lateral midpoint of the outlet portion of the opening and divides the overall flow volume of the opening into a first flow volume $V_1$ adjacent the upwardly bent wall segment 50 and a second flow volume $V_2$ equal to the flow volume $V_1$ and positioned generally forwardly of the volume $V_2$ and adjacent the wall segment 64. The interior plate surface area bounding the portion of the opening 36*a* within the volume $V_1$ is substantially greater than the interior plate surface area bounding the portion of the opening 36*a*—representatively from about 2 times greater to about 8 times greater, and representatively about five times greater.

Turning now to FIG. 6, which illustrates the flow of combustion air 40 through a representative one of the flame quenching combustion air inlet openings 36 in the louvered flame arrestor plate 34, the above-described configurational aspects of the plate 34 provide the flow of combustion air 40 traversing each opening 46 with a unique set of characteristics that provides the arrestor plate 34 with various operational advantages compared to conventionally configured flame arrestor plate constructions.

For example, the shape of each flame quenching opening 36, in addition to preventing the flow of flame downwardly therethrough, causes combustion air 40 traversing the opening 36 to pass therethrough in a laminar flow portion 40*a* disposed adjacent the planar bottom side surface 54 of the plate segment 50, a turbulent flow portion 40*b* adjacent the front plate segment 64, and a transitional flow portion 40*c* disposed between the flow portions 40*a* and 40*b*. AS the combustion air 40 upwardly traverses the flame quenching opening 36 its velocity increases due to the substantial narrowing of the opening 36 at its outlet. Additional turbulence is imparted to the air 40 as it exits the opening 36 due to the interaction with the air of the facing, parallel plate edges 60,62 at the exit of the opening 36. Combustion air 40 entering each opening 36 has at least two directional changes imparted thereto before it exits the opening 36.

This added turbulence imparted to the exiting air 40 creates counter-rotating vortices 40*d* and 40*e* therein at the opening exit. The high degree of discharged air turbulence at the exit of each of the flame quenching combustion air inlet openings substantially prevents the build-up of lint or other airborne particulate matter at the openings 36, thereby advantageously maintaining the free flow of combustion air 40 through the arrestor plate 34 and avoiding the necessity of frequently cleaning the plate to unclog the openings 36. Lint or other particulate matter which may fall toward the exit portions of the opening 36 from within the combustion chamber 24 upon cessation of burner operation can simply fall through the gaps G (see FIG. 5) built into the louvered opening configurations.

When the burner structure 26 is subsequently lit, the resulting detonation force within the combustion chamber 24 acts to outwardly flush lint or other particulate matter through the openings 36. Then, when combustion air 40 is drawn into the combustion chamber 24, the resulting air turbulence adjacent the exits of the openings 36 tends to disperse lint or other particulates on the upper side of the arrestor plate 34 adjacent the openings 36.

Because at each of the flame quenching openings 36 the outlet velocity is substantially greater than the inlet velocity, the interior combustion chamber pressure adjacent the openings 36 is lower than the ambient pressure along the bottom side 46 of the plate adjacent the openings 36. This pressure differential is quite uniform over the surface area of the arrestor plate 34. Accordingly, during firing of the burner structure 26 the combustion air inflow over the area of the arrestor plate 34 is also quite uniform over the area of the bottom side of the flame arrestor plate 34. The temperature of the plate is thus substantially uniform over its area as is the lint deposition pattern on the non-perforated bottom side area of the arrestor plate 34. Further, due to this uniform distribution of combustion air flow through the arrestor plate 34, the operational noise attributable to the plate is desirably diminished.

Moreover, compared to conventional flame arrestor plate geometries, the above-described geometry of the arrestor plate 34 beneficially provides for each flame quenching plate opening 36 a very large ratio of internal surface area to outlet area. Representatively, this ratio is in the range of from about 120 to about 150, and is preferably about 130. This high ratio provides the arrestor plate 34 with improved flame quenching capabilities, and also facilitates the above-mentioned high degree of turbulence in the combustion air 40 upwardly exiting the flame quenching openings 36.

The foregoing detailed description is to be clearly understood as being given by way of illustration and example only, the spirit and scope of the present invention being limited solely by the appended claims.

What is claimed is:

1. Fuel-fired heating apparatus comprising:

a combustion chamber thermally communicatable with a fluid to be heated;

a burner operatively disposed within said combustion chamber; and a flame arrestor plate structure having a generally planar body defining a wall portion of said combustion chamber and having a spaced series of louvered openings therein configured to permit combustion air to flow therethrough into said combustion chamber and substantially preclude flame passage outwardly therethrough from said combustion chamber, each of said louvered openings being bordered by a bounding portion of said body including first and second spaced apart body wall segments, each louvered opening having an inlet on a first side of said body, and an outlet disposed on a second side of said body and having an area substantially smaller than the area of said inlet, said first body wall segment being angled relative to the plane of said body and having a generally planar side surface and a first corner edge that partially bound the louvered opening, said second body wall segment having a generally planar end surface and a second corner edge that partially bound the louvered opening, said first and second corner edges extending along said outlet in a spaced apart, parallel relationship.

2. The fuel-fired heating apparatus of claim 1 wherein:

said fuel-fired heating apparatus is a gas-fired water heater.

3. The fuel-fired heating apparatus of claim 1 wherein:

each of said bounding portions of said body is operative to create counter-rotating vortices in combustion air exiting its associated louvered opening and entering said combustion chamber.

4. The fuel-fired heating apparatus of claim 1 wherein:

at each louvered opening said first corner edge is disposed at the juncture of said side surface of said first body wall segment and a generally planar end surface of said first body wall segment which is sloped outwardly away from said second body wall segment.

5. The fuel-fired heating apparatus of claim 4 wherein:

said end surface of said first body wall segment is sloped, at an angle within the range of from about zero degrees to about 15 degrees, relative to a reference plane transverse to said plane of said body.

6. The fuel-fired heating apparatus of claim 5 wherein:

said angle is approximately 12 degrees.

7. The fuel-fired heating apparatus of claim 1 wherein:

each of said louvered openings is elongated in a direction parallel to its associated f irst and second corner edges.

8. The fuel-fired heating apparatus of claim 7 wherein:

the width of each louvered opening inlet is within the range of from about 0.08" to about 0.10", and the width of each louvered opening outlet is within the range of from about 0.015" to about 0.023".

9. The fuel-fired heating apparatus of claim 8 wherein:

the width of each louvered opening inlet is approximately 0.085", and the width of each louvered opening outlet is approximately 0.018".

10. The fuel-fired heating apparatus of claim 7 wherein:

each of said louvered openings has a minimum length within the range of from about 0.10" to about 0.20".

11. The fuel-fired heating apparatus of claim 10 wherein:

each of said louvered openings has a minimum length of approximately 0.15".

12. The fuel-fired heating apparatus of claim 1 wherein:

said body is of a metal material and has a thickness in the range of from about 0.15" to about 0.040".

13. The fuel-fired heating apparatus of claim 12 wherein:

said thickness is approximately 0.026".

14. The fuel-fired heating apparatus of claim 1 wherein:

each of said louvered openings has a ratio of interior surface area to outlet opening area which is greater than about 120.

15. The fuel-fired heating apparatus of claim 1 wherein:

each of said louvered openings has a total flow volume defined by a first flow volume extending along said generally planar side surface, and a second flow volume equal to said first flow volume and extending along said generally planar end surface of said second body wall segment, and the interior plate surface area contacted by said first flow volume is substantially greater than the interior plate surface area contacted by said second flow volume.

16. The fuel-fired heating apparatus of claim 15 wherein:

the ratio of the interior plate surface area contacted by said first flow volume to the interior plate surface area contacted by said second flow volume is within the range of from about 2 to about 8.

17. The fuel-fired heating apparatus of claim 16 wherein:

said ratio is approximately 5.

18. The fuel-fired heating apparatus of claim 1 wherein:

said first and second corner edges are separated from one another, in a direction parallel to the plane of said body, by a gap distance within the range of from about 0" to about 0.23".

19. The fuel-fired heating apparatus of claim 18 wherein:

said gap distance is approximately 0.01".

20. The fuel-fired heating apparatus of claim 1 wherein:

said bounding portion of said body is operative to create in combustion air flowing through the louvered opening into said combustion chamber a laminar flow area extending along said generally planar side surface, a turbulent flow area extending along said generally planar end surface, and a transitional flow area disposed between said laminar flow area and said turbulent flow area.

21. The fuel-fired heating apparatus of claim 1 wherein:

said bounding portion is operative to impart at least two directional changes to combustion air inwardly traversing the louvered opening.

22. Fuel-fired heating apparatus comprising:

a combustion chamber thermally communicatable with a fluid to be heated;

a burner operatively disposed within said combustion chamber; and a flame arrestor plate structure having a generally planar body defining a wall portion of said combustion chamber and having a spaced series of louvered openings therein configured to permit combustion air to flow therethrough into said combustion chamber and substantially preclude flame passage outwardly therethrough from said combustion chamber, each of said louvered openings having an inlet and an outlet and being bordered by a bounding portion of said body, said bounding portion being operative to create counter-rotating vortices in combustion air being discharged from said outlet into said combustion chamber.

23. The fuel-fired heating apparatus of claim 22 wherein:

at each of said louvered openings said bounding portion includes first and second spaced apart body wall segments, and said bounding portion is further operative to create in combustion air flowing through the louvered openings into said combustion chamber a laminar flow area extending along said first body wall segment, a turbulent flow area extending along said second body wall segment, and a transitional flow area disposed between said laminar flow area and said turbulent flow area.

24. The fuel-fired heating apparatus of claim 22 wherein:

at each of said louvered openings said inlet has an area substantially greater than the area of said outlet, whereby the pressure of combustion air exiting said outlet into said combustion chamber is substantially less than the pressure of combustion air entering said inlet.

25. The fuel-fired heating apparatus of claim 22 wherein:

each of said louvered openings has a ratio of interior surface area to outlet opening area which is greater than about 130.

26. The fuel-fired heating apparatus of claim 22 wherein:

each of said louvered openings has a total flow volume defined by a first flow volume extending along said first body wall segment, and a second flow volume equal to said first flow volume and extending along said second body wall segment, and the interior plate surface area contacted by said first flow volume is substantially greater than the interior plate surface area contacted by said second flow volume.

27. The fuel-fired heating apparatus of claim 22 wherein:

at each of said louvered openings said first and second body wall segments are separated, in a direction parallel to the plane of said body, by a gap through which particulate matter may fall.

28. The fuel-fired heating apparatus of claim 22 wherein:

said fuel-fired heating apparatus is a gas-fired water heater.

29. The fuel-fired heating apparatus of claim 22 wherein:

said bounding portion is operative to impart at least two directional changes to combustion air inwardly traversing the louvered opening.

30. A flame arrestor plate structure for use in conjunction with a combustion chamber of a fuel-fired heating appliance, such as a gas-fired water heater, comprising:

a generally planar body having first and second opposite sides; and a spaced series of louvered combustion air inlet openings extending through said body between said first and second sides, each of said louvered combustion air inlet openings being:

(1) configured to permit combustion air to flow therethrough from said first side to said second side and substantially preclude flame passage therethrough from said second side to said first side, and (2) bordered by a bounding portion of said body including front and rear spaced apart body wall segments, each louvered combustion air inlet opening having an inlet on said first side of said body, and an outlet disposed on said second side of said body and having an area substantially smaller than the area of said inlet, said rear body wall segment being forwardly and outwardly angled relative to said second side of said body and having a generally planar side surface and a first corner edge that partially bound the louvered combustion air inlet opening, and a generally planar front end surface rearwardly and outwardly sloped at an acute angle relative to a reference plane transverse to said body, and said front body wall segment having a generally planar end surface and a second corner edge that partially bound the louvered combustion air inlet opening, said first and second corner edges extending along the periphery of said outlet in a spaced apart, parallel relationship.

31. The flame arrestor plate structure of claim 30 wherein:

said acute angle relative to said reference plane is within the range of from about zero degrees to about 15 degrees.

32. The flame arrestor plate structure of claim 31 wherein:

said acute angle relative to said reference plane is approximately 12 degrees.

33. The flame arrestor plate structure of claim 30 wherein:

each of said louvered combustion air inlet openings is elongated in a direction parallel to its associated first and second corner edges.

34. The flame arrestor plate structure of claim 33 wherein:

the width of each inlet is within the range of from about 0.08" to about 0.10", and the width of each outlet is within the range of from about 0.15" to about 0.23".

35. The flame arrestor plate structure of claim 34 wherein:

the width of each inlet is approximately 0.085", and the width of each outlet is approximately 0.018".

36. The flame arrestor plate structure of claim 33 wherein:

each of said louvered combustion air inlet openings has a minimum length within the range of from about 0.10 " to about 0.20".

37. The flame arrestor plate structure of claim 36 wherein:

each of said louvered combustion air inlet openings has a minimum length of approximately 0.15".

38. The flame arrestor plate structure of claim 30 wherein:

said body is of a metal material and has a thickness in the range of from about 0.15" to about 0.040".

39. The flame arrestor plate structure of claim 38 wherein:

said thickness is approximately 0.026".

40. The flame arrestor plate structure of claim 30 wherein:

each of said louvered combustion air inlet openings has a ratio of interior surface area to outlet opening area which is greater than about 120.

41. The flame arrestor plate structure of claim 30 wherein:

each of said louvered combustion air inlet openings has a total flow volume defined by a first flow volume extending along said generally planar side surface of said rear body wall segment, and a second flow volume equal to said first flow volume and extending along said generally planar end surface of said front body wall segment, and the interior plate surface area contacted by said first flow volume is substantially greater than the interior plate surface area contacted by said second flow volume.

42. The flame arrestor plate structure of claim 41 wherein:

the ratio of the interior plate surface area contacted by said first flow volume to the interior plate surface area contacted by said second flow volume is within the range of from about 2 to about 8.

43. The flame arrestor plate structure of claim 42 wherein:

said ratio is approximately 5.

44. The flame arrestor plate structure of claim 30 wherein:

said first and second corner edges are separated from one another, in a direction parallel to the plane of said body, by a gap distance within the range of from about 0" to about 0.23".

45. The flame arrestor plate structure of claim 44 wherein:

said gap distance is approximately 0.010".

* * * * *

UNITED STATES PATENT AND TRADEMARK OFFICE

CERTIFICATE OF CORRECTION

PATENT NO. : 6,422,178 B1 
DATED : July 23, 2002
INVENTOR(S) : Eric M. Lannes, Mark A. Taylor and Larry D. Kidd It is certified that error appears in the above-identified patent and that said Letters Patent is hereby corrected as shown below:

Column 9,
Lines 41 and 51, delete "22" and insert -- 23 -- in place thereof.

Signed and Sealed this

Eighth Day of March, 2005

JON W. DUDAS
*Director of the United States Patent and Trademark Office*